US005731663A

United States Patent [19]

Davis

[11] Patent Number: 5,731,663

[45] Date of Patent: Mar. 24, 1998

[54] VARIABLE POWER CONTROL LAMP ADAPTER

[76] Inventor: Ralph K. Davis, 1524 Timber Creek Dr., San Jose, Calif. 95131

[21] Appl. No.: 625,902

[22] Filed: Apr. 1, 1996

[51] Int. Cl.[6] ..... H05B 37/02

[52] U.S. Cl. ..... 315/194; 315/58; 315/71; 362/221; 439/641; 439/642; 439/638; 439/741; 323/905

[58] Field of Search ..... 315/58, 71, 194, 315/56; 362/410, 411, 295, 221; 439/638, 641, 642, 741

[56] References Cited

U.S. PATENT DOCUMENTS

| | | | |
|---|---|---|---|
| 3,103,618 | 9/1963 | Slater . | |
| 3,292,007 | 12/1966 | Tiemann . | |
| 3,300,711 | 1/1967 | Duncan . | |
| 3,331,013 | 7/1967 | Cunningham . | |
| 3,385,944 | 5/1968 | Mackiewicz et al. . | |
| 3,450,941 | 6/1969 | Butts | 315/194 |
| 3,573,543 | 4/1971 | Grindstaff | 315/194 |
| 3,893,019 | 7/1975 | King et al. | 323/327 |
| 3,997,820 | 12/1976 | Stefani | 361/820 |

*Primary Examiner*—Robert Pascal
*Assistant Examiner*—Arnold Kinkead
*Attorney, Agent, or Firm*—Gene Scott - Patent Law & Venture Group

[57] ABSTRACT

A variable power lamp control adapter is provided having a novel, different, and a lower cost construction method than that used in prior art lamp control devices. The circuit construction is achieved by utilization of the Surface Mount Technology disciplines of Polymer Thick Film and Chip on Board technologies. The adapter circuitry is constructed and held on a uniquely dissimilar type of substrate than that used in prior art, and assembled into housings that contain unique interengaging mating parts for a more rapid assembly process than the assembly processes used in prior art construction. In the present invention an overall improvement in the organization, arrangement of all componets, housings and assembly is achieved for a reliable power control operation.

11 Claims, 6 Drawing Sheets

VARIABLE POWER CONTROL LAMP ADAPTER

FIELD OF THE INVENTION

This invention relates to a manufacturing method for a power control apparati, and more particularly, is directed toward an improved electric lamp dimming device.

BACKGROUND OF THE INVENTION

The manufacturing and assembly methods used in prior art lamp dimmers has remained relatively static since the introduction of the first phase controlled electronic dimming device. Two distinct methods of circuit construction have been dominant through out the production history. The first method constituted a circuit structure of packaged electronic component terminals interconnected by a flexible conductor and hand soldered for a permanent physical and electrical configuration. An example of this structure is an early patent to Slater, U.S. Pat. No. 3,103,618. This patent also describes the general operation of the phase control dimmer. A later patent to Tiemann, U.S. Pat. No. 3,292,007 describes a different component circuit arrangement than that used by Slater, but configured into the same electrical and physical arrangement by manual soldering as that used by Slater. Later patents, Mackiewicz et al, U.S. Pat. No. 3,385,944; Duncan, U.S. Pat. No. 3,300,711; Cunningham, U.S. Pat. No. 3,331,013, all employ the same circuitry interconnect method as that of Slater and Tiemann. These electronic circuits were then attached to housings by the use of metal fasteners such as screws, rivets, and eyelets, and the housings then assembled into a final configuration by use of the same type of fastening devices. The second method of circuit construction is best described by the utilization of packaged components with their electrical terminals inserted into a plurality of through holes contained on a printed circuit board so that all conductive portions of the components could be interconnected by a single soldering operation. King, et al, U.S. Pat. No. 3,893,019, and Stefani, U.S. Pat. No. 3,997,820 best show this method. These circuit assemblies and housing members of these patented devices were then made into a final configuration by the use of mechanical fasteners such as screws, eyelets, rivets and drive pins. The cost of the packaged electronic components have remained quite stable throughout production history, with the cost of assembly labor appreciating with changes in the minimum wage scale and inflationary pressures. This factor has prompted some domestic manufacturers to relocate their assembly process to lower cost labor areas.

The manufacturing method of the present invention addresses the cost components directly, and achieve a significant reduction in both cost and size of the electronic circuitry.

Technologies employed in the construction of the present invention are identified in the industry as surface mount or SMT, polymer thick film or PTF, and chip on board or COB technologies. Herein, these technologies will be referred to by these titles or by their other name as referred to in their industry acronym. Surface mount technology applies to the discipline of attaching electronic components lead terminations directly to a substrate surface, as opposed to mounting the components lead terminations into through holes contained in the substrate. Polymer thick film is the nomenclature applied to the process of attaching low cost conductive or resistive inks to a substrate surface by screen printing or by other transfer techniques, and using cure temperatures of less than 300 degrees C. COB is the discipline of attaching bare electronic components, that have no external protective encasement or lead wires, to the surface of a provided substrate. Such manufacturing processes are applicable to a wide variety of circuitry and substrate materials. The present invention introduces novel circuitry and a unique circuit board type not used in prior art lamp dimming devices.

OBJECTS OF THE INVENTION

It is an object of the present invention to provide a dimmer device that is constructed by a unique and less expensive method than that used for the construction of prior art devices. It is another object of the present invention to provide a dimmer device that is enclosed in improved housings and is assembled bled by novel and improved techniques not found in the assembly of prior art devices. It is another object to provide a dimmer device that utilizes an improved printed circuit substrate containing components of a different form factor than prior art units. This invention fulfills all of these requirements and provides further related advantages.

SUMMARY OF THE INVENTION

The present invention is a variable power adapter for controlling the power delivered to an electric lamp, removably disposed within a conventional electric lamp socket and containing a conductive holder electrode for threadably engaging an electric lamp. The power control device includes a non-conductive tubular base supporting a circuit assembly, a cylindrical control ring, and a second tubular holder extending upwardly from the base. The circuit assembly uses a different form of electronic components and circuit substrate than that used in prior art devices, and is constructed in a unique and lower cost method than that used in prior art devices, employing the manufacturing disciplines of Surface Mount Technology, and in particular Polymer Thick Film (PTF) and Chip on Board technology (COB). The present invention further provides a variable power control device that is enclosed in improved housings that facilitate a more efficient and lower cost assembly method than that used in the assembly of prior art devices.

BRIEF DESCRIPTION OF THE DRAWINGS

The accompanying drawings illustrate the invention. In such drawings.

DETAILED DESCRIPTION OF THE PREFERRED EMBODIMENT

Figure 1:
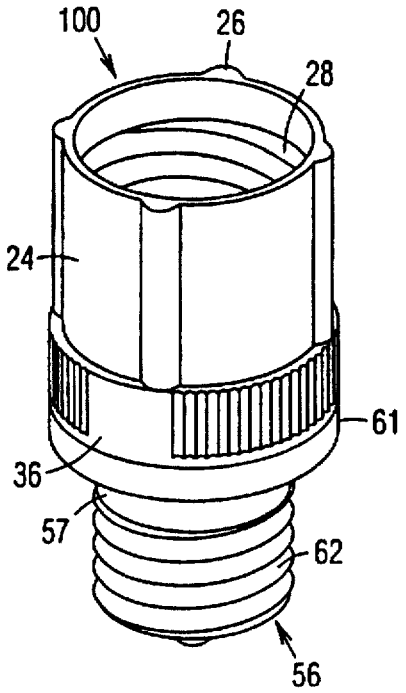
FIG. 1 is a perspective view of a variable power control lamp adapter.
Figure 2:
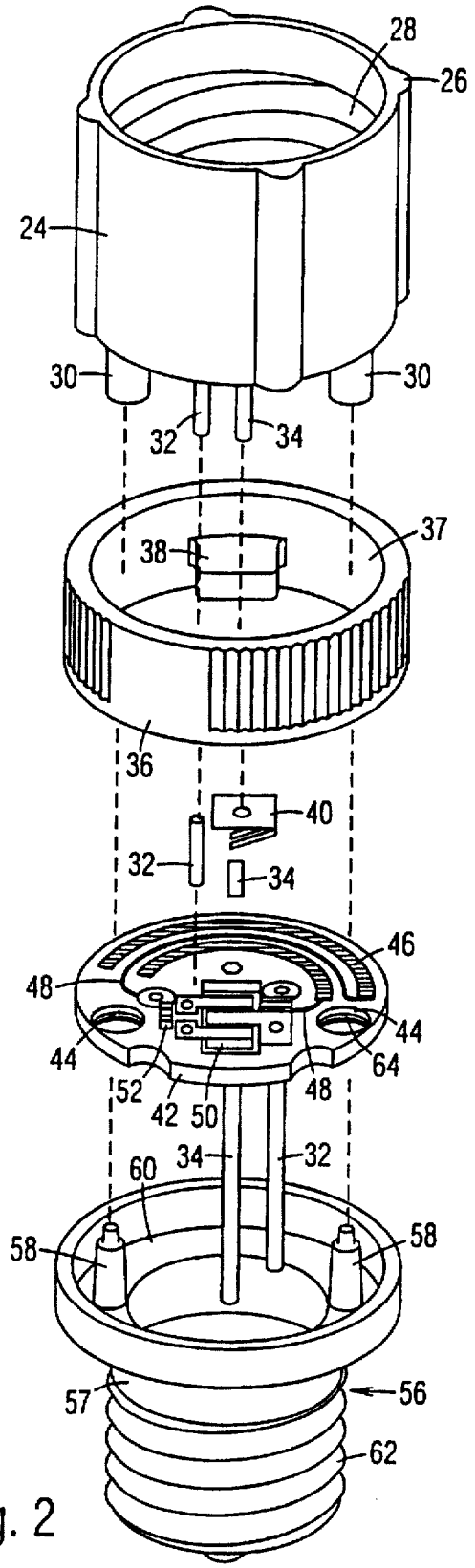
FIG. 2 is a perspective exploded view of the invention, illustrating two tubular housings, a contact blade, a control ring, and a circuit board assembly.
Figure 3:
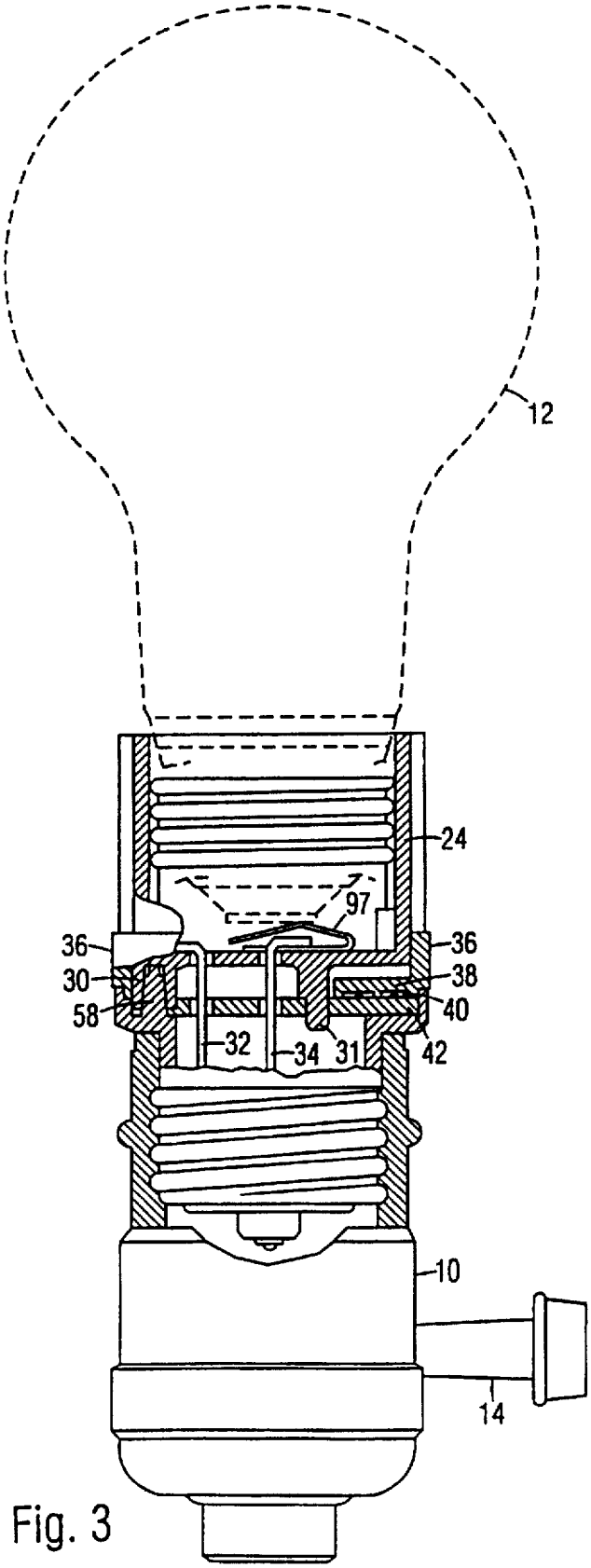
FIG. 3 is a perspective view with cutaways depicting a lamp control adapter connected electrically to a standard lamp socket and to a standard incandescent electric light bulb.

FIGS. 1, 2, and 3 show different views of an adjustable power control device 100 that may be threadably engaged with a conventional standard electric lamp socket 10, to which a source of electrical power is connected, and an electric lamp 12. The power control device 100 enables the magnitude of power provided to the electric lamp 12 to be selectively varied.

Figure 4:
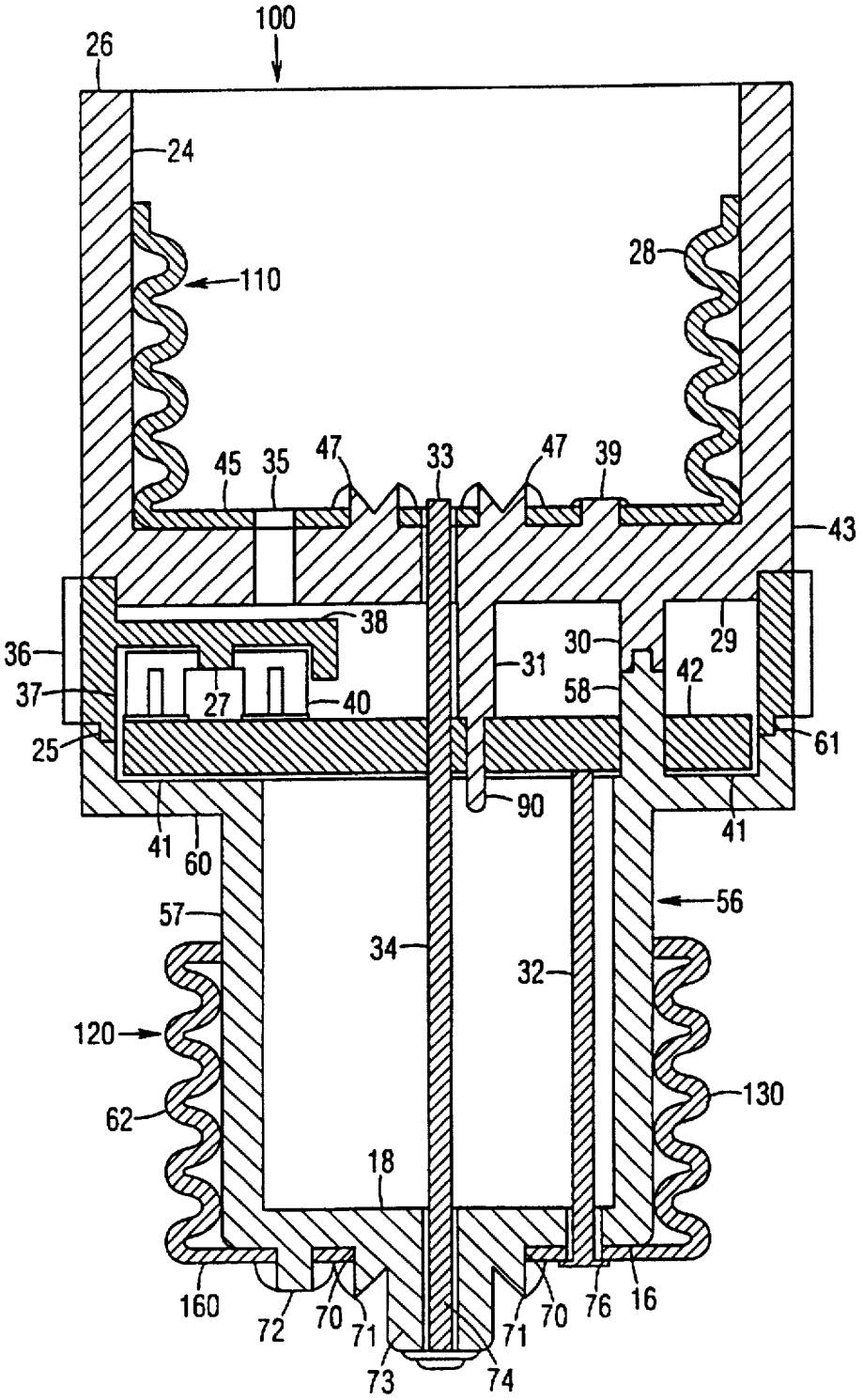
FIG. 4 is a cross-sectional view of the invention, illustrating threaded electrodes engaged with their tubular holders, wire conductors, and a metallic contact engaging a printed circuit board.

FIG. 4 is a cross sectional view showing a tubular base 56 providing an integral cylindrical base side wall 57 enclosed at a first lower end 16 by a base end wall 18. A circuit board support means 60 of base 56 includes an upfacing first peripheral edge 61 and a first upwardly extending attachment means 58. The end wall 18 includes a centrally located tab 73 with a first clearance bore 74 therethrough, a first locating tab 72, and a downwardly extending rectangular wall 71, and a second clearance bore 76 therethrough. The tubular base 56 is made from any suitable rigid, non-conductive material, such as plastic. A base electrode 120 of conductive sheet metal provides a cylindrical base electrode side wall 130 formed as a continuous external screw thread 62. The electrode side wall 130 is slidably engaged over the side wall 57 in mutual contact thereon. A base electrode end wall 160 contacts the base end 16, and has a first rectangular perforation means 70 aligning the rectangular downwardly extending wall 71 and downwardly extending tab 73, and other perforation means aligning with clearance bore 76 and locating tab 72 of end wall 18. Base electrode 120 is permanently attached to tubular base 56 by ultrasonic peening of plastic wall 71 and locating tab 72.

Figure 5:
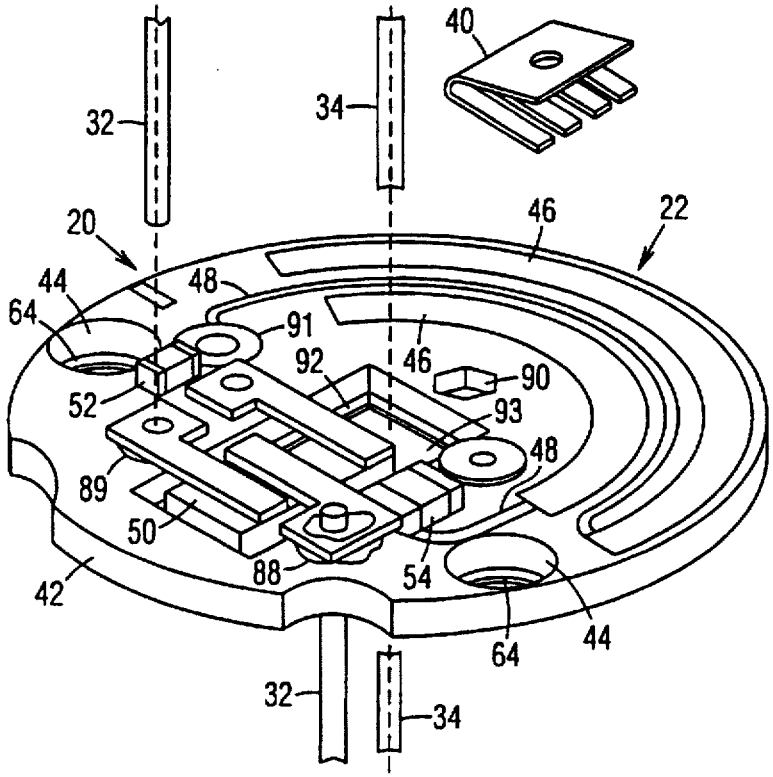
FIG. 5 is a perspective view of a molded plastic substrate with three separate elevations, containing passive unencapsulated PTF components on one elevation to form an R-C network for phase control, a semiconductor quadrac on another elevation, and a third elevation to receive and locate a second tubular; housing.
Figure 6:
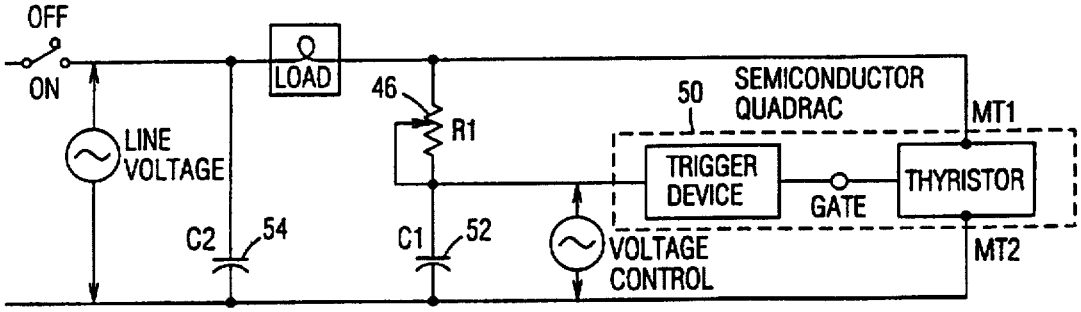
FIG. 6 is the schematic circuit for the power control adapter

FIG. 5 shows a circuit assembly 20 contained on a first surface elevation of a a disk shaped plastic circuit board 42. The circuit board 42 provides clearance means 93 and second elevation 92 for locating Triac 50 and accompanying heat sink (heat sink not shown on FIG. 5), a clearance bore 44 with a third elevation 64 for location of the interengaging attachment means 58 and 30 (FIG. 2), a circuit means 22 to comprise a selectively adjustable R-C network which is coupled between the semiconductor Triac 50 and the source of power 32. The selectively adjustable R-C network 22 functions as a phase shifting network for controlling the portion of the cycle of applied line voltage at which a positive or negative pulse is applied to Triac 50 to effect the electrical conduction and thereby control the power applied to load 12. The R-C network 22 comprises a pair of PTF concentric are resistor traces 46 connected to an unencapsulated capacitor 52 through PTF conductor trace 48.

The selectively variable circuit function is provided by a movable metallic wiper 40 held in position by an inwardly extending tray 38 attached to rotatable ring 36. As the wiper 40 is varied in its position on the PTF resistor traces 46 by the rotation of ring 36 the resistance component of the R-C phase control network 22 is changed. The electrical output signal of the R-C network being directly coupled to Triac 50, a change in resistance value of traces 46 changes the phase of this signal to load 12, thereby varying the delivered power and output lumens.

Unencapsulated capacitor 54 is bonded to the surface of circuit board 42 by PTF conductors (not shown on FIG. 5) that are connected to the input sides of conductors 32 and 34 and provides a highly effective Radio Frequency Interference (RFI) filter for successful lamp dimming operation.

The present invention uses the SMT components PTF and COB technologies to bond the unencapsulated components of the RFI filter and the R-C network component of circuit means 22 directly to the surface of circuit board 42, forming both the final electrical circuit configuration and the physical component configuration simultaneously, thereby minimizing both labor and component costs to achieve a lower manufactured circuit assembly than that of prior art manufactured units.

Housings are comprised of a first tubular base 56, a cylindrical control ring 36, and a second tubular holder 26, all of which are made of a non-conductive material such as plastic. Control ring 36 is positioned above base 56 and circuit assembly 20, and is formed as a circular rim 37 for providing a downfacing second peripheral edge 25. The control ring 36 is positioned on base housing 56 such that the second peripheral edge 25 is in sliding contact with the first peripheral edge 61. A contact blade support tray 38 extends radially inward from the rim 37 for providing a contact blade fastening means 27 for engaging a metallic conductor contact blade 40 that extends downwardly to contact the circuit means 22 contained on the surface of circuit board 42 for electrical interconnection therewith. The circuit board support means 60 of housing 56 is a ring shaped peripheral surface 41 for resting the circuit board 42 thereof and further supporting a peripheral circular lip 61 that constrains the circuit board 42 to a central concentric location on the base 56.

The non-conductive second tubular holder 26 is positioned above the control ring 36 and is in sliding contact therewith. The tubular holder 26 integrally provides a holder side wall 24, enclosed at a second lower end 29 by a holder end wall 43. The holder end wall 43 includes a centrally located clearance bore 33 therethrough, a second clearance bore 35 therethrough, upwardly extending locating tabs 39 and 47, and downwardly extending attachment means 30 so positioned for mutual interengagement with the first attachment means 58 of base 56. Second tubular holder 26 further includes a dual diameter locating stud 31 extending downwardly from the holder end wall 43 (FIG. 3). The circuit board 42 (FIG. 5) also provides a through hole 90 therein that is located to interengage stud 31 of end wall 43, with their respective diameters so configured as to achieve a press fit upon mating, and for establishing a fixed and permanent horizontal relationship and distance between circuit board 42 and second tubular holder 26. The first and second attachment means 58 and 30 are a plurality of interengaging studs and tubular bosses, with their respective diameters so configured as to such that upon mating a press fit is achieved for establishing a fixed and permanent perpendicular relationship between tubular base 56, circuit board 42, control ring 36, and tubular holder 26. This joined connection between the base holder 56 and second holder 26 may be made integral to the assembly by the addition immediately before mating of either a Solvent or adhesive bonding material.

The non-conducting second tubular holder 26 contains a conductor electrode 110 of sheet metal formed as a continous internal screw thread 28 of a size for accepting an electric lamp. The electrode side wall is slidably engagable within the inner side of holder side wall 24 and is in mutual contact thereon. The holder electrode end wall 45 contacts the holder end wall 43. The holder electrode end wall 45 has perforation means for alignment with plastic locating tabs 39 and 47 and with end wall 43 clearance bores 33 and 35. Holder electrode 110 is permanently attached to second holder 26 by ultrasonic peening of plastic locating tabs 39 and 47.

A conductor means 32 and 34 electrically interconnect a 120 volt AC power source in series to the base electrode 120, semiconductor Triac 50, R-C network circuit means 22, spring contact 97, and lamp 12 through clearance bores 74, 76,33, and 35 for a selectively varied power control adapter. The adjustable power control device preferably further contains, in the circuit assembly, a non-magnetic radio frequency Interference filter.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An adjustable power control device of the type adapted to threadably engage an electric lamp socket to which a source of electrical power is provided, and further adapted to threadably engage an electric lamp, for enabling the magnitude of an electrical power provided to the electric lamp to be selectively varied, the power control device comprising:

a tubular base, integrally providing a cylindrical base side wall enclosed at a first lower end by a base end wall, and further providing a circuit board support means at a first upper end of the base side wall, the support means further including an upfacing first peripheral edge and a first, upwardly extending, attachment means, the base end wall including a centrally located first, and a second clearance bore therethrough, and a first and second locating tab;

a tubular base electrode of sheet metal providing a cylindrical base electrode side wall formed as a continuous external screw thread, the electrode side wall being slidably engagable over the cylindrical base side wall in mutual contact thereon, and a base electrode end wall in contact with the base end wall, the electrode end wall having perforation means aligned with the clearance bores and locating tabs of the base, with the base electrode being permanently affixed to the base end wall by ultrasonic peening of the locating tabs of the base;

a disk shaped plastic circuit board positioned for support by the support means, the board providing clearance means for engaging the attachment means, and further providing electric circuit means for varying the phase angle between voltage and current of the power supplied to the lamp;

a cylindrical control ring positioned above the circuit board, and formed as a circular rim providing a downfacing second peripheral edge, the control ring being positioned on the support means such that the second peripheral edge is in sliding contact with the first peripheral edge, a contactblade support extending radially inward from the rim and providing a contact fastening means for engaging a metallic conductor contact blade extending downwardly in contact with the circuit board for electrical interconnection therewith;

a tubular holder positioned above the control ring, and in sliding contact therewith, and integrally providing a cylindrical holder side wall enclosed at a second lower end by a holder end wall including a centrally located third and a fourth clearance bore therethrough, and a third and a fourth upwardly extending locating tab, and a downwardly extending dual diameter locating means positioned for mutual engagement with the circuit board, and a downwardly extending attachment means positioned for mutual engagement with the first attachment means of the base;

a tubular holder electrode of sheet metal providing a cylindrical holder electrode side wall formed as a continuous internal screw thread of a size for accepting the electric lamp, the electrode side wall being slidably engagable within a holder side wall in mutual contact thereon, and a holder electrode end wall in contact with the holder end wall, the electrode end wall having perforation means aligned with the third and forth clearance bores and the third and forth locating tabs the electrode being permanently affixed to the holder end wall by ultrasonic peening of the third and forth locating tabs;

conductor means electrically interconnecting the first, second, third and forth electrodes to the circuit board such that by rotating the control ring the phase angle between voltage and current of the electric power delivered to the lamp is varied in order to control the magnitude of power delivered to the lamp, with the control ring being accessible from any 360 degree position thereto.

2. The adjustable power control device of claim 1 wherein the conductor means are permanently affixed to the housing by ultrasonic peening of the locating tabs.

3. The adjustable power control device of claim 1 wherein the tubular holder provides downwardly extending tubular bosses for interengaging with upwardly extending studs affixed to the tubular base that upon mating of the two parts achieves a press fit.

4. The adjustable power control device of claim 3 where interengaging the tubular bosses and studs form an integral part of the assembly with the addition of either a solvent or adhesive bonding material.

5. The adjustable power control device of claim 1 wherein the tubular holder provides a downwardly extending dual fixed diameter stud for insertion into a provided fixed diameter through hole in the circuit board that upon the mating of the two parts a press fit is achieved and aligns the tubular holder and the circuit board into a fixed horizontal relationship.

6. The adjustable power control device of claim 1 wherein the circuit board support means is a ring shaped peripheral surface for resting the circuit board thereon, and further supporting a peripheral circular lip, the lip constraining the circuit board to a central concentric location on the base.

7. The adjustable power control device of claim 1 wherein the circuit board is formed and configured of a molded plastic material with at least two separate elevations.

8. The adjustable power control device of claim 7 wherein the circuit board is formed of a molded plastic material comprising:

a first elevation level for printing and bonding;

a second elevation level for locating and holding a semiconductor triac and a heat sink assembly;

a third elevation level for locating the holder both horizontally and vertically with respect to the tubular base.

9. The adjustable power control device of claim 8 wherein a plurality of polymer thick film layers are molecularly bonded to a surface of the molded plastic circuit board thereby forming a network of discrete resistive and conductive circuit elements.

10. The adjustable power control device of claim 9 wherein a plurality of unencapsulated discrete elements comprising conductors, resistors, capacitors, and semiconductors are attached to the surface of the circuit board and provide at least two electrical contacts establishing electrical interconnection with at least two of the film layers and establishing mechanical support integrity of the elements on the circuit board, the elements and the layers forming the electrical power circuit.

11. The adjustable power control device of claim 10 further containing in the circuit assembly a non-magnetic radio frequency Interference filter.

* * * * *